United States Patent [19]

Webb

[11] 4,423,288

[45] Dec. 27, 1983

[54] MODULAR TELEPHONE JACK

[75] Inventor: Gerald F. Webb, Thorndale, Canada

[73] Assignee: Northern Telecom Limited, Montreal, Canada

[21] Appl. No.: 89,242

[22] Filed: Oct. 29, 1979

[51] Int. Cl.[3] ..... H01R 13/40; H01R 13/54

[52] U.S. Cl. ..... 339/176 M; 339/218 M

[58] Field of Search ..... 179/1 PC, 1 C, 2 C; 339/17 LC, 99 R, 176 M, 218 R, 218 M

[56] References Cited

U.S. PATENT DOCUMENTS

| | | | |
|---|---|---|---|
| T961,003 | 8/1977 | Krumreich | 179/1 PC |
| 3,569,903 | 3/1971 | Brishka | 339/74 |
| 3,850,497 | 11/1974 | Krumreich et al. | 339/176 M |
| 3,990,764 | 11/1976 | Krumreich | 339/176 M |
| 4,070,548 | 1/1978 | Kasper | 179/1 PC |
| 4,153,327 | 5/1979 | Johnson | 339/176 M |
| 4,202,593 | 5/1980 | Abernethy et al. | 339/176 M |
| 4,224,485 | 9/1980 | Krumreich | 179/1 PC |

*Primary Examiner*—Bernard Konick
*Assistant Examiner*—Randall P. Myers
*Attorney, Agent, or Firm*—Sidney T. Jelly

[57] ABSTRACT

A modular telephone jack is formed of two parts, top and bottom, which slide together, moving interengaging formations at a front end to hold the front ends together, and at least one detent at the other end of the top part with a resilient member in engagement with the detent to retain the two parts assembled. An additional feature, cantilever spring wire contact members are molded into the top part at one end of each contact member, the contact members extending into an aperture defined by the top and bottom parts.

6 Claims, 13 Drawing Figures

MODULAR TELEPHONE JACK

This invention relates to a modular telephone jack and is particularly concerned with a two-part jack with a resilient deflectable member, or deflectable members, engaging in a detent, or detents, to hold the two parts together.

Jacks for conventional plugs are generally made in two parts, upper and lower, which are then assembled together as by bonding. For wall outlets and similar positions, the jack forms part of a larger member with a lower part molded integrally with the larger member. The top part is separately molded, cantilever spring contact wires inserted and then the subassembly attached to the bottom, for example, as stated above, by bonding. The present invention provide for assembly of the top part to the bottom part by laterally sliding the top part into position with interengaging formations at one end, the end first moved into sliding contact, and a resilient member, or resilient members, which are deflected by insertion of the top part, engaging in a detent, or detents, to retain the top part in position. This avoids a bonding step.

Broadly, the present invention provides a modular telephone jack having two parts, a bottom part and a top part, interengaging formations on one end of each part, for convenience referred to as the front ends, and a resilient member, or resilient members at the rear part of the bottom part, with a cooperative detent, or detents at the rear of the top part.

In a further feature of the invention the cantilever spring wire contact members, instead of extending through the top part, in bores, and then being bent down and back at the front end to extend rearwardly, are molded into the top part and extend therefrom.

The invention will be readily understood by the following description of certain embodiments, by way of example, in conjunction with the accompanying drawings, in which.

Jacks generally, for ease of manufacture, comprise two main parts, a top part which holds the cantilever spring wire contact members, hereinafter referred to as the wire contact members and the bottom part which has a profiled slot which, in combination with the top part defines a profiled aperture for reception and retention of a plug.

Figure 1:
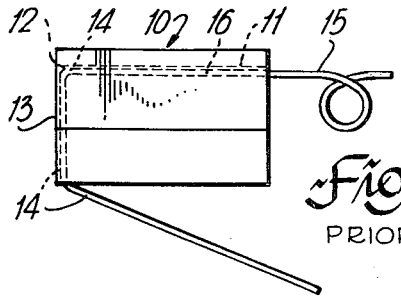
Fig. 1 PRIOR ART
FIG. 1 is a side view of a top part of a conventional jack.
Figure 3:
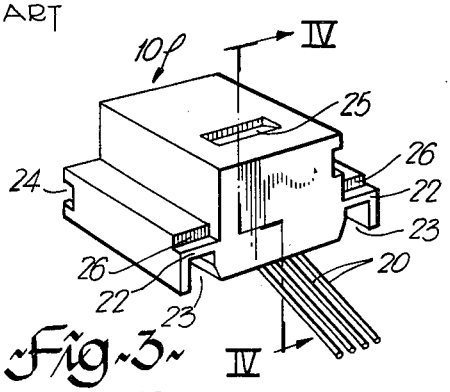
FIG. 3 is an end view in the direction of arrow A in FIG. 2.

FIG. 1 illustrates a conventional form of a top part of a jack. It comprises a molded plastic body 10 having a plurality of bores 11 therethrough. From one end of the bores 11, grooves 12 extend down the end face 13. Wire contact members 14 extend in the bores 11, down the grooves 12 and then back along under the top part, being inclined away from the body 10 to form cantilever spring contact portions. Flexible conductors 15 are connected to the wire contact members 14, the connection usually being contained in the bores 11, for example at 16. This form of assembly is described and illustrated for example in U.S. Pat. No. 3,850,497.

To prevent corrosion and to ensure good electrical contact between the wire contact members and contact members in a mating plug the wire contact members are gold plated. The wire contact members are plated before attachment of the flexible conductors 15. The wire contact members are then assembled to the body 10 by insertion into the bores 11 followed by bending down into the grooves 12 and a further bending back under the body 10.

FIGS. 2, 3, 4 and 5 illustrate a top part as provided by the present invention. The top part has a body 10 of molded plastic. In the example illustrated in FIGS. 2, 3, 4 and 5, the wire contact members 20 are molded into the body 10 at one end 21. The wire contact members are molded in to give the desired initial inclination, as can be seen in the cross-section of FIG. 4, to give the required contact forces. However, the wire contact members can be of the form as in FIG. 1, with the required bores provided.

The particular embodiment illustrated in FIGS. 2 to 5 is intended to be formed, that is molded, as a separate part, a top part, for assembly to a bottom part. To this end, the body 10 has two lateral extensions 22, one at each side, each extension having a longitudinal groove 23 in its lower surface. The grooves receive complimentary ribs on the bottom part.

Figure 2:
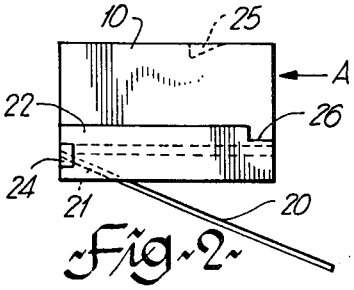
FIG. 2 is a side view of a top part of a jack in accordance with the present invention.
Figure 4:
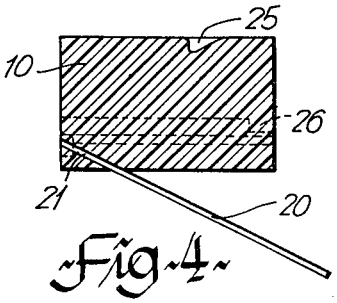
FIG. 4 is a cross-section on the line IV—IV of FIG. 3.
Figure 5:
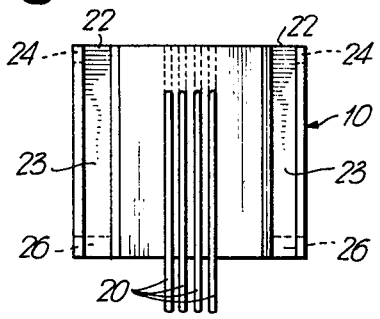
FIG. 5 is a bottom plan view of the part illustrated in FIGS. 2, 3 and 4.

As illustrated in FIG. 2, a recess 24 is formed in the forward ends of the outer parts of the lateral extensions 22. Also, a detent, or groove 25 is formed in the top surface of the body 10, near the rear end of the part. As seen in FIG. 4, the forward edge or side of the recess 25 is substantially vertical while the rear edge or side is inclined. Finally, at the rear end of each lateral extension 22 is formed a detent or step 26. The recesses 24 provides for holding down the front end of the part when assembled to a bottom part, while the detent 25 and the detents 26 provide alternative ways for retaining the top part in position.

Figure 6:
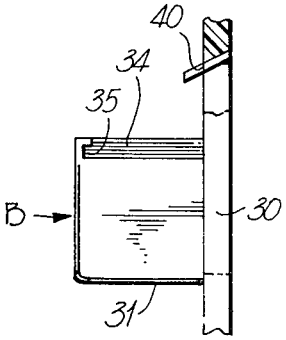
FIG. 6 is a side view of one form of a bottom part of a jack for assembly with a part as in FIGS. 2 to 5.
Figure 8:
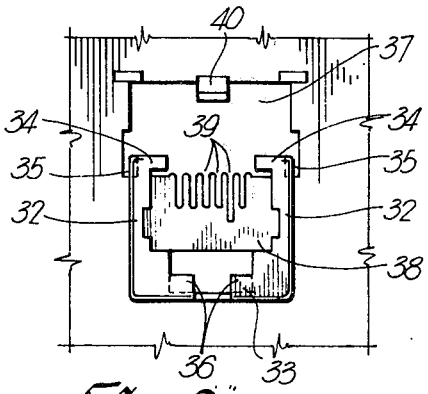
FIG. 8 is a front view in the direction of arrow B in FIG. 6.
Figure 7:
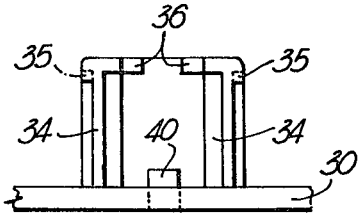
FIG. 7 is a top plan view of the part of FIG. 6.

The top part, with the retaining means, can be used with two different forms of bottom parts, for two different forms of jack. FIGS. 6 to 8 illustrates one form of bottom part which is basically a flat plate-like member 30 with a protruding member 31 which cooperates with a top part to form a profiled aperture for receiving a plug. As illustrated, the member 31 has two spaced walls 32 and a base 33 connecting the walls. The top edges 34 of the walls are reduced in thickness for the major part of their length from the member 30, to form ribs, with an undercut 35 at the end. The walls 32 have a profiled cross-section to accept the plug profile and two locking projections 36 at the front end engage with a latch on the plug. This arrangement is well known, for example as described in U.S. Pat. No. 3,850,497.

An aperture 37 extends through member 30 for passage of the top part therethrough. The member 30 forms a back wall 38 to the protruding member 31 and in the top edge of this wall 38 is formed a "comb", comprising a plurality of slots, and extending down from the top edge. The number of slots can vary and one, or more, of the slots may extend down further, as shown. At the top edge of the aperture 37 is a resilient tab 40.

Figure 9:
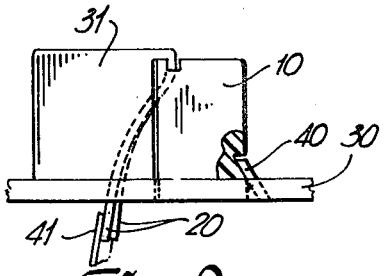
FIG. 9 is a side view of an assembled jack composed of the two parts illustrated in FIGS. 2 to 5 and 6 to 9.

FIG. 9 illustrates the assembly of a top part as in FIGS. 2 to 5 with a bottom part as in FIGS. 6, 7 and 8. The top part is inserted through the aperture 37 with the grooves 23 in the extensions 22 sliding on the reduced thickness top edges or ribs 34 of the walls 32. The top part is pushed forward until the recesses 24 cooperate with the undercuts 35, the lower part of the ends of the outer parts of the lateral extensions, below the recesses 24, engaging in the undercuts 35. This locates and holds down the front end of the top part. As the top part is pushed through the aperture 37 the tab 40 is pushed up. When the top part is fully pushed in the end of the tab 40 drops into the detent or groove 25. This holds down the rear end of the top part and also prevents rearward movement of the top part. As the top part is pushed in the wire contact members 20 enter the slots 39 and are biased to a predetermined position. Conductors can be connected to the extreme ends of the wire contact members 20 and conveniently this can be done by a flexible circuit having contact areas which are soldered to the ends of the wire contact members. Such a circuit member is indicated at 41 in FIG. 9.

Figure 10:
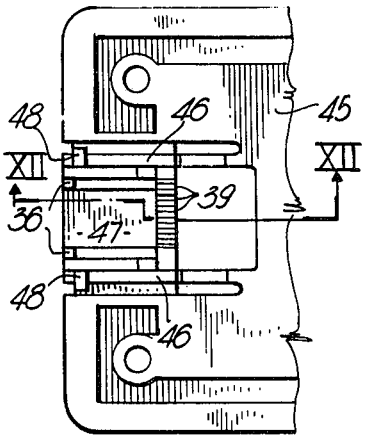
FIGS. 10 and 11 are top plan view and front view respectively of another form of the other part of the jack.
Figure 11:
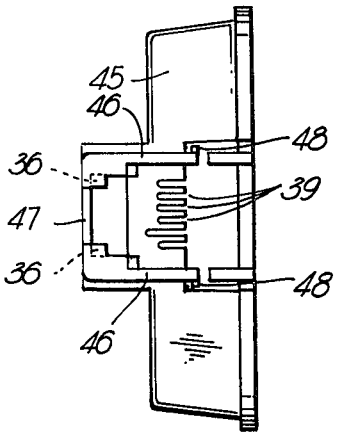
Figure 12:
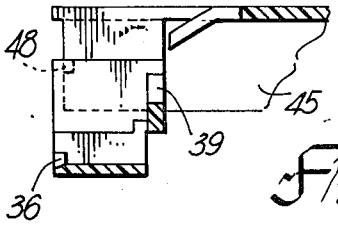
FIG. 12 is a cross-section on the line XII—XII of FIG. 10.
Figure 13:
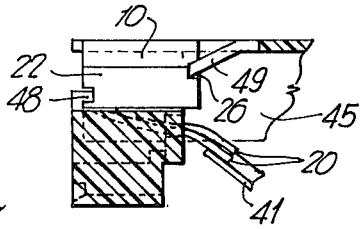
FIG. 13 is a cross-section on the same line as FIG. 12 but illustrating the assembly of the parts illustrated in FIGS. 2 to 5 and 10 to 12.

FIGS. 10, 11 and 12 illustrate an alternative form of bottom member. In this form the plug receiving aperture is formed at one edge of a member 45. Side walls 46 and a base 47 defined the bottom of the aperture. Projections 36 are provided for engagement with the plug latch as in the embodiment of 2, 3 and 4. At the forward ends of the top edges of the walls 46 are formed two outwardly extending projections 48. A rear wall 49 of the plug receiving aperture has a "comb" formed in its top edge, comprising slots 39 as in the embodiment of FIGS. 6, 7 and 8. The walls 46 and base 47 project below the main member 45. A top portion as in FIGS. 2 to 5 can be pushed in from the member 45, with the grooves 23 sliding on the top edges of the walls 46. The recesses 24 engage with the projections 48 to locate and hold down the front end of the top part. Extending down from the part 25 are two resilient members 49. The members 49 are deflected upward as the top part is pushed in, but drop down and engage in the detents or steps 26. This prevents the top part from moving rearward. This is illustrated in FIG. 13. As in the assembly illustrated in FIG. 9, the wire contact members 20 enter the slots 39 and are biased to a predetermined position. Conductors can be attached to the ends of the wire contact members, for example by means of a flexible circuit indicated at 41.

In the particular form of the top part illustrated in FIGS. 2, 3, 4 and 5 as stated above, the wire contact members 20 are molded in. As compared with the contact members 14 of FIG. 1, it will be seen that there is considerably less wire to be gold plated and also bends are avoided. Bends often cause cracking of the gold plate, with associated corrosion. The wire contact members can be produced from a roll by automatic cutting members, and one end can be roughened, if desired, for improving bonding between wire and body. However this may require correct orientation of the lengths of wire prior to insertion in the mold, or roughening of both ends, depending on whether the free ends were in contact with contact members in a mating plug. Further, it is not essential that the full length of each wire be plated, only that portion in contact with the contact members of a plug. Other corrosion resistant low contact resistance plating can be used, e.g. silver.

The free ends of the contact members 20 can be splayed apart sideways to permit wider spacing of contact areas on the circuit member. Alternatively the free ends can be bent alternately up and down so as to be capable of being soldered on both sides of a circuit member, that is, some contact members on one side and others on the other side. This will also give increased spacing.

What is claimed is:

1. A modular telephone jack having a top part and a bottom part, in superposed position, said top and bottom parts defining an aperture therebetween for reception of a modular plug;

said top part comprising a main body portion, a lateral extension along each side of the main body portion, a groove extending along the bottom surface of each extension, a recess in the forward end of each extension; a recess in the top surface of each extension adjacent to the rear end thereof, and a recess in the top surface of the main body portion adjacent to the rear end thereof;

said bottom part comprising a wall member having an aperture therein for reception of said top part, two parallel spaced apart walls extending forward normal to the plane of said wall member, an upper edge on each side wall, said edges forming ribs for sliding engagement in said grooves in said lateral extensions; a rearwad facing extension at the front end of each upper edge for engagement in the recesses in the forward ends of the extensions; at least one deformable member extending into said aperture and engageable in one of said recesses.

2. A jack as claimed in claim 1, including an end wall extending between said spaced apart walls in said bottom part at a rear end thereof and a plurality of slots extending down from a top edge of said end wall to form a comb, and a plurality of spring wire contact members extending from a front end of said top part rearwards in said aperture defined by said top and bottom parts for reception of a modular plug, the contact members positioned individually in at least some of said slots.

3. A modular telephone jack having a top part and a bottom part, in superposed position, said top and bottom parts defining an aperture therebetween for reception of a modular plug;

said top part comprising a main body portion, a lateral extension along each side of the main body portion, a groove extending along the bottom surface of each extension, a recess in the forward end of each extension, a recess in the top surface of each extension adjacent to the rear end thereof; and a recess in the top surface of the main body portion adjacent to the rear end thereof;

said bottom part comprising a flat plate-like member, a protruding member extending forward from said plate-like member, said protruding member including two parallel spaced side walls extending forward normal to said plate-like member, said walls each having an upper edge forming a rib for sliding engagement in said grooves in said lateral extensions, an aperture in said plate-like member for passage of said top part therethrough onto said side walls, a rearward facing extension at the front end of each upper edge of said walls for engagement in said recesses in the forward ends of the extensions on said top part; and a deformeable member extending from said plate-like member into said aperture in said plate-like member for engagement in said recess in said top surface of the main body portion of the top part.

4. A jack as claimed in claim 3, including an end wall extending between said spaced side walls, and a plurality of slots extending down from a top edge of said end wall to form a comb, and a plurality of spring wire contact members extending from a front end of said top part rearwards in said aperture defined by said top and bottom parts, the contact members positioned individually in at least some of said slots.

5. A modular telephone jack having a top part and a bottom part, in superposed position, said top and bottom parts defining an aperture therebetween for reception of a modular plug;

said top part comprising a main body portion, a lateral extension along each side of the main body portion, a groove extending along the bottom surface of each extension, a recess in the forward end of each extension, a recess in the top surface of each extension adjacent to the rear end thereof, and a recess in the top surface of the main body portion adjacent to the rear end thereof;

said bottom part comprising a flat back member having an edge extending forward therefrom, a protruding member extending from said edge and including two parallel spaced side walls extending normal to said edge, said side walls each having a top edge for sliding engagement in said grooves in said lateral extensions, an aperture in said edge for passage of said top part therethrough onto said side walls, and an aperture in said flat back member contiguous with said aperture in said edge, the top surface of said top part received in said aperture in said back member, a rearward facing extension at the front end of each top edge for engagement in said recesses in the forward ends of the extensions on said top part, and two deformeable members extending from said back member into said aperture in said edge for engagement in said recesses in the top surfaces of said lateral extensions on said top part.

6. A jack as claimed in claim 5, including an end wall extending between said spaced side walls, and a plurality of slots extending down from a top edge of said wall to form a comb, and a plurality of spring wire contact members extending from a front end of said top part rearwards in said aperture defined by said top and bottom parts, the contact members positioned individually in at least some of said slots.

* * * * *